United States Patent [19]

Diamond et al.

[11] Patent Number: 4,735,349

[45] Date of Patent: Apr. 5, 1988

[54] IRRITANT AEROSOL SPRAY

[75] Inventors: George B. Diamond; Ralph Helmrich, both of Glen Gardner, N.J.

[73] Assignee: Diamond Aerosol Corporation

[21] Appl. No.: 345,657

[22] Filed: Feb. 4, 1982

[51] Int. Cl.[4] ..... B65D 83/14

[52] U.S. Cl. ..... 222/402.1; 222/402.25; 222/501; 222/518

[58] Field of Search ..... 222/402.1, 402.25, 501, 222/518

[56] References Cited

U.S. PATENT DOCUMENTS

| | | | |
|---|---|---|---|
| 2,570,909 | 10/1951 | Benson et al. | 222/501 X |
| 2,900,114 | 8/1959 | Utz | 222/518 X |
| 3,166,250 | 1/1965 | Kappel | 222/518 X |

FOREIGN PATENT DOCUMENTS

| | | | |
|---|---|---|---|
| 234174 | 5/1924 | United Kingdom | 222/402.25 |
| 620884 | 3/1949 | United Kingdom | 222/402.25 |

*Primary Examiner*—David A. Scherbel

*Attorney, Agent, or Firm*—Ostrolenk, Faber, Gerb & Soffen

[57] ABSTRACT

An irritant aerosol spray container has an opening into which a valve assembly fits and a gasket is positioned between the valve assembly and the container such that the portion of the gasket in communication with the interior of the container is substantially free of material extractable by halocarbon to form color in the extractant. A safety for the spray is also disclosed operable between first and second positions to permit and prohibit operation of the irritant spray as desired. A variety of irritant sprays particularly adapted to various conditions are also described.

7 Claims, 3 Drawing Sheets

FIG. 7
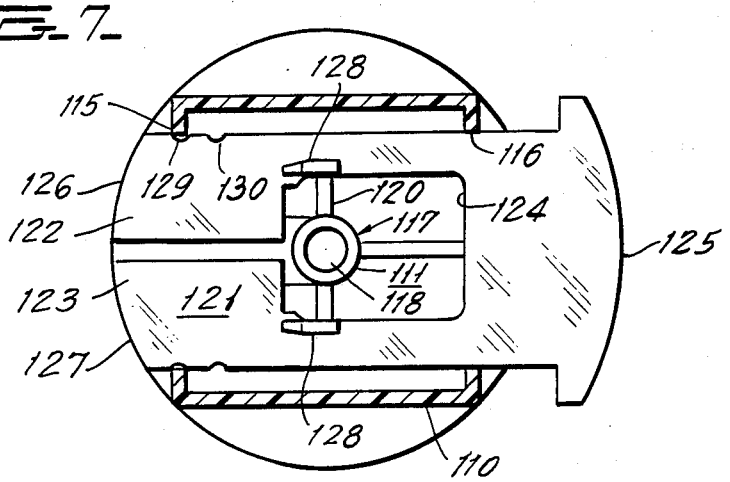
FIG. 10
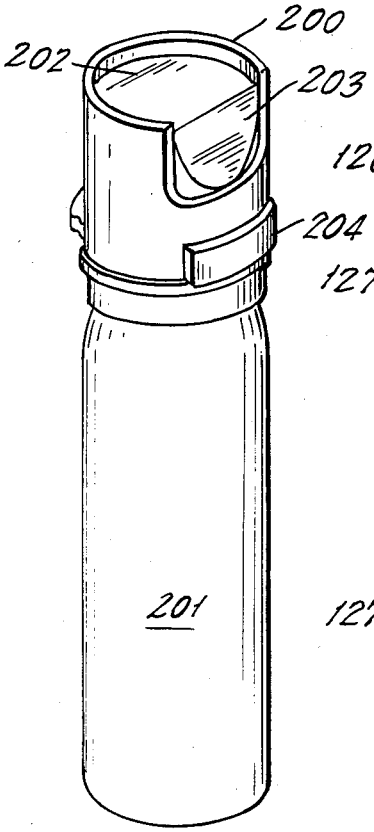
FIG. 8
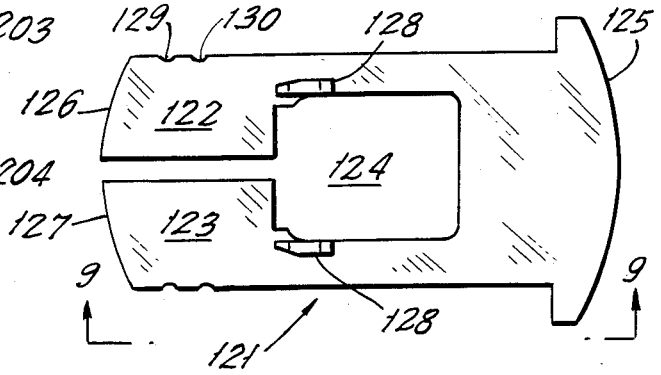
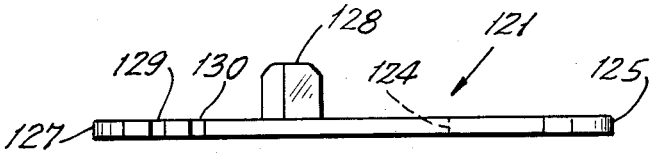
FIG. 9

IRRITANT AEROSOL SPRAY

BACKGROUND OF THE INVENTION

The purpose of this invention is to provide a group of products which are specially designed for self protection under various conditions. Although each of these products is an aerosol spray irritant, the individual units are designed to function properly under certain limiting conditions similar in principle to the differences between the use of a shotgun, rifle or pistol depending on conditions. Thus, a person would not use a pistol to get wide coverage at minimum distance and would not use a shotgun for long distance accuracy. The present state of the art in irritant sprays is that the user has very little choice and as a practical matter, can only try to use the available unit for all purposes and hope for the best.

A number of irritant spray products are available but their use is limited by a variety of factors. Their reaction may be slow, and their range and spray characteristics limited. Additionally, many products have an inadequate shelf-life such that the irritant effect is lost over a period of time from as short as one month to one year or more depending on the construction of the irritant spray unit and temperature to which it is exposed. An additional problem with existing spray units is that they can be easily accidentally actuated. For example, if the spray unit is being carried in a pocket or purse, the other contents present such as keys or the like can press against the unit actuator causing it to discharge. The user could also accidentally depress the actuator when trying to remove the spray unit from the pocket or purse. A cover for the unit would avoid such possibilities but is unacceptable because of the extra time required to remove the cap before the spray unit is available for use and it also requires the use of two hands to perform this operation. Substantially immediate availability for use and a free hand to ward off an attacker are extremely desirable characteristics of the aerosol irritant spray device. Any spray preventing safety device should also be easily operated in the dark by feel alone so that the unit can be used at night or under conditions where visibility is impaired.

It is accordingly the object of this invention to provide a variety of aerosol irritant spray units adapted for use under a variety of conditions, which possess an adequate shelf-life and which can be provided with a safety device for preventing unintended actuation of the unit. This and other objects of the invention will become apparent to those skilled in the art from the following detailed description in which FIG. 1 is a cross section through the axis of an aerosol can of a first embodiment of the invention showing a portion of an aerosol spray unit with a valve assembly constructed in accordance with the present invention;

Figure 4:
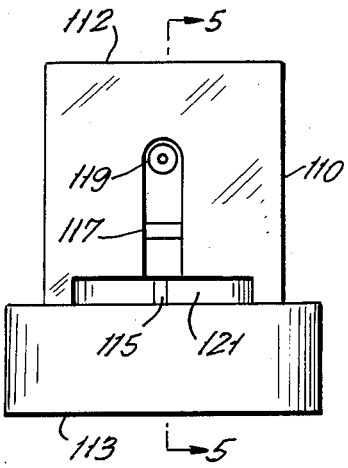
FIG. 4 is an elevation view of the output nozzle side of an actuator and valve assembly provided with the safety device of the present invention.
Figure 6:
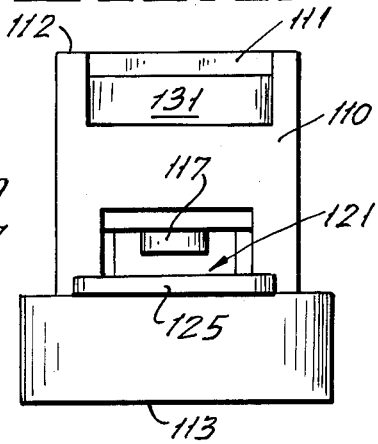
Figure 5B:
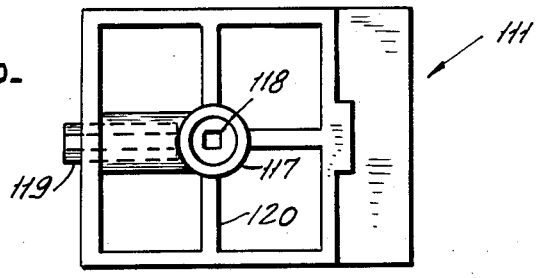
FIG. 5 is a cross sectional view of FIG. 4 taken across section line 5—5 in FIG. 4.
Figure 5:
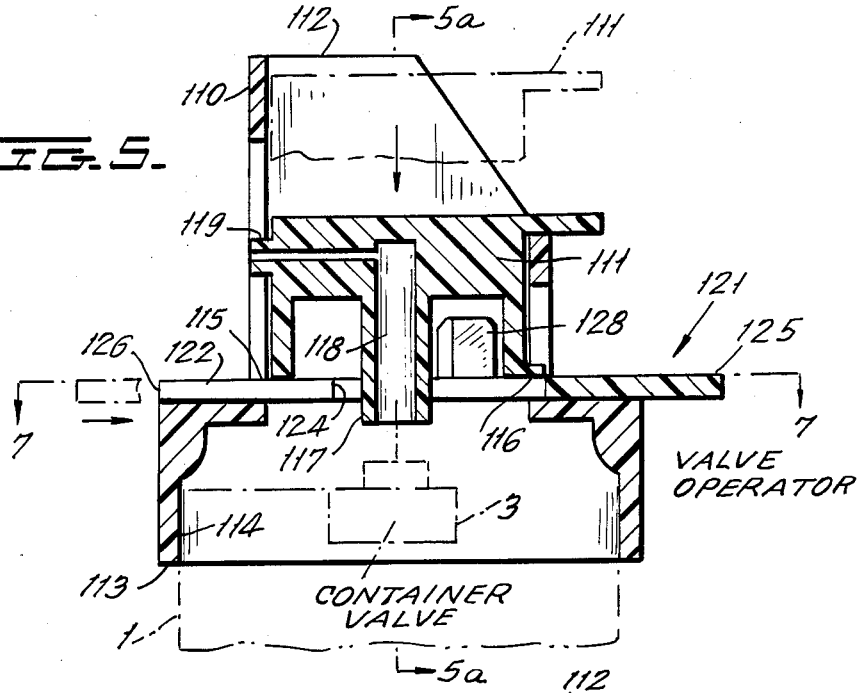
Figure 5A:
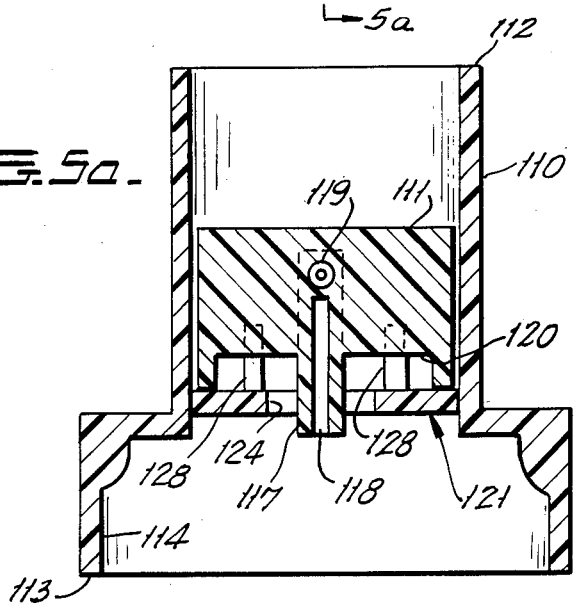

FIG. **5*a* is a cross sectional view of FIG. 5 taken across section lines 5*a*—5*a* of FIG. 5**;

FIG. **5*b*** is a bottom view of the valve actuator;

FIG. 6 is an elevation view of the assembly of FIG. 4 as seen from the trigger side of the housing;

FIG. 7 is a cross sectional view of FIG. 5 taken across section line 7—7 in FIG. 5;

FIG. 8 is a plan view of the safety slide of the present invention;

FIG. 9 is a plan view of the safety slide of FIG. 8 along lines 9—9; and FIG. 10 is a perspective view of a fourth embodiment of the invention.

SUMMARY OF THE INVENTION

The present invention pertains to a group of aerosol irritant spray units which are adapted for use under varying limiting conditions. The invention also concerns an aerosol spray unit having improved shelf life by constructing the gasket which seals the opening in the container and the valve assembly such that the portion of the gasket in the communication with the interior of the container which contains the irritant is substantially free from material which is extractable by halocarbon to form color in the extractant. The invention also concerns a valve assembly in which the valve actuator housing is provided with a slide member operable between a first position which permits operation of the activator and a second position which prohibits operation of the actuator.

DESCRIPTION OF THE INVENTION

The aerosol irritant spray units contain a composition which has three basic components which are used to expel an aerosol spray or stream. These are the active irritant, the propellant and a solvent for the active irritant. The active irritant in current use is CS.

The propellant can be a liquified low boiling point (below 80° F.) material such as a chlorofluorocarbon or hydrocarbon, a dissolved gas such as carbon dioxide or nitrous oxide or a non-soluble gas such as nitrogen. The particular propellant chosen depends on the use intended. The liquified propellants are desirable for a short range of about 3–6 feet, issue as fine particles and can be employed in a narrow temperature range because they do not work at low temperatures or at very high temperatures. The dissolved gases such as carbon dioxide or nitrous oxide have a medium range of about 8–10 feet, provide a medium to coarse particle size and are operable over a wide temperature range. The non-soluble gases are particularly useful for long range operation of about 10–15 feet, have a coarse particle size and are operable over a wide range.

The solvent used in the aerosol spray must be able to dissolve the irritant, must be inert to the container and the valve gasket, plastic parts, nozzle and other mechanical components with which it comes into contact, must be physiologically safe since it is designed to be sprayed onto an individual's face, mouth and eyes, must be stable with respect to the active irritant and must not react with the active irritant. Typical solvents include ketones such as acetone, methyl ethyl ketone, methyl isobutyl ketone and the like and alcohols such as isopropyl alcohol. The preferred solvent is acetone which is known to be physiologically safe and have a threshold limit value of about 1000 ppm. It has been found preferable to use a cosolvent in the composition and typical cosolvents include the halogenated and fluorinated hydrocarbons such as trichlorotrifluoroethane and the like which have a boiling point range above 80° F. Trichlorotrifluoroethane, specifically 1,1,2-trifluoro-1,2,2-trichloroethane, the preferred cosolvent, is physiologically safe having threshold values over 1000 ppm and does not flash off during the spray process since it boils at 117.6° F. and therefore does not control the range or particle size of the spray.

In general, the active irritant, CS, will be about 0.5–1.5% of the aerosol composition and the solvent system will be about 83.5–99.5% of the composition. Preferably the solvent will be about 8–15% and the cosolvent about 75.5–91.5% of the aerosol composition. The balance of the aerosol composition is the propellant and any other materials which may be employed, such as a dispersant.

It will be appreciated that the active irritant does not affect the spray characteristics and other active irritants can be used in such percentages which will give the desired degree of activity and safety. The 0.5–1.5% CS is, therefore, merely a guide and higher or lower percentages and different types of irritants can also be used.

There are five classes of aerosol irritant spray products which are desirable. These are (1) a product for use in the home and designed to be sprayed through a partly opened door; (2) a product used in a store or a similar environment; (3) a product to be used against animals in a hunting and camping environment; (4) a product to be used from inside a vehicle such as through a window or door; and (5) a product to be used either outdoors or indoors to protect an individual against personal attack. Each of these products require a different range, spray characteristics, temperature dependence, blow-back characteristics and ease of accessibility. The "blow-back" depends on wind force and particle size of the spray. For example, class 1 which is to be used indoors and fired through a door should have a spray pattern which is more vertical than horizontal and should have a range of 3 to 5 feet and also should have a spray pattern of 1.5 feet in diameter (average of the long and short axis), should function through a temperature range of 55°–120° F. and have a medium blow-back characteristic. In order to visualize the differences among the five classes of products, these requirements are tabulated in Table I:

TABLE I

| Product # | Range | Spray Pattern | Blow Back | Temp. Range |
|---|---|---|---|---|
| #1. (to be fired through a door) | 3–5 ft. | 2 × 1 ft. at average range | medium not blown back in wind or draft. | 65–120° F. |
| #2. (to be used in store or other business) | 4–6 ft. | 2 × 2 ft. at average range | no wind or draft fine spray can be used. | 55–120° F. |
| #3. (for hunters and campers) | 8–10 ft. | 1 × 1 ft. | can be very windy, coarse paticle spray must be used. | −20–120° F. |
| #4. (used from vehicle) | 3–5 ft. | 1½ × 1½ ft. | can be very windy and due to confined area, a very coarse particle spray must be used. | −20°–120° F. |
| #5. (personal protection) | 8–10 ft. | 1½ × 1½ ft. at average range | can be windy; coarse particle must be used but good scatter at close range also necessary. | −20°–120° F. |

As can be seen from Table I, a unit of class 2 would not be very useful outdoors in a wind or where a longer range is needed. Similarly, a condition where a blow back from the wind into a vehicle cannot be tolerated cannot be solved by using a unit having a fine particle spray or even a medium spray such as that of class 1.

We have found that different amounts of carbon dioxide or nitrous oxide effect the range, particle size, spray pattern and blow back characteristics and that the addition of small amounts of low boiling (under 80° F.) chloroflorocarbon and/or hydrocarbon dispersant causes finer particles to be generated due its flash off or evaporation. For a aerosol with a nozzle orifice of 0.015 to 0.040 inch, the class 1 units should contain the carbon dioxide or nitrous oxide propellant to a pressure of about 30–60 psig measured at 70° F., the amount being controlled by the pressure, and about 1–3% of the low boiling chlorofluorocarbon or hydrocarbon dispersant. For a product of class 2, the amount of propellant should be equal to 40 to 50 psig at 70° F. and contain about 5–7% dispersant. Products of classes 3, 4 and 5 should contain 45–50 psig, 35–45 psig and 40–50 psig at 70° F., respectively, and no dispersant.

It is generally known that the irritant CS dissolved in a liquid is stable only for relatively short periods of time. Generally the stability is 0.5–2 years at room temperature and much shorter periods at elevated temperatures. It has been determined that one of the factors effecting stability is the degree of water present in the system. CS reacts in the presence of water to produce a non-irritant reaction product. The irritant system, therefore, should be substantially anhydrous with the amount of moisture below about 0.1% and preferably below about 0.07%. It is substantially impossible to reduce the amount of water below about 0.05%.

Despite the maintenance of substantially anhydrous conditions, the storage stability of the composition in its container is often not acceptable. In this connection, acceptable storage stability means that the irritant retains about 50% of its original strength so that it is effective. We have surprisingly discovered that the cause of the decomposition of the CS irritant lies not in the irritant composition itself but rather a material which acts as a catalyst for the decomposition in the presence of any degree of water is contained in the gasket which seals the valve of the aerosol container from the container itself. A typical valve and gasket arrangement is shown in FIG. 1.

The aerosol container is usually cylindrical although other shapes can be used if so desired. The numeral 1 designates the walls of the container which are provided with a peripheral aperture 2 within which the valve assembly is placed. A valve 3 is situated in a retainer 4 and biased into a closed position by any suitable means such as spring 5. A cover 6 through which a portion of valve 3 passes is provided to enclose the valve assembly and to complete the sealing of aperture 2 by being crimped against container walls 1 as at crimp 7. To provide a seal between the valve assembly and cover 6 at the point where the valve 3 extends through aperture 2 in cover 6, a gasket 8 is provided. Gasket 8 is normally isolated from the contents of the container by the actuator assembly and, therefore, does not normally contribute to the decomposition of the CS irritant. Since the container walls 1 and the retainer 4 are normally constructed of a hard material such as a metal or hard plastic, a second gasket 9 is interposed between retainer 4 and walls 1 to ensure a proper seal between cover 6 and container 1. Gasket 9 is normally exposed to the interior of the container and we have found that it is this second gasket 9 which contains the decomposition catalyst.

Figure 2:
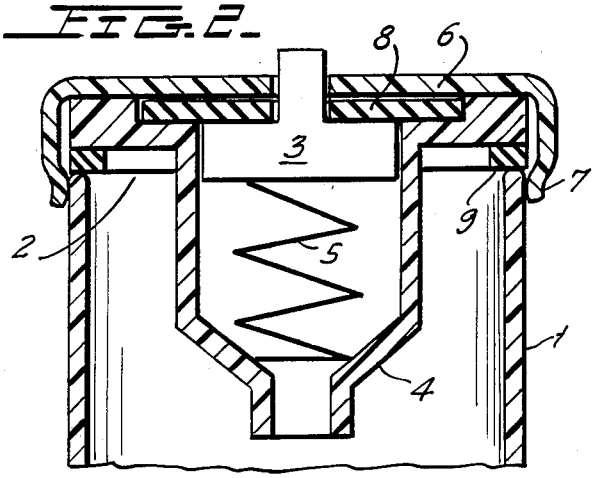
FIG. 2 is a cross section similar to that of FIG. 1 showing a second embodiment of the present invention.

Gasket 9 is a compressable material such as a soft plastic or rubber. Typically, rubbers such as buna rubber, neoprene, EPDM and the like have been employed. In the preparation of the rubber material which is formed into the gasket, some material is incorporated which acts as the CS decomposition catalyst. While we do not know what precisely the catalyst is, we have been able to determine that its presence can be identified by a simple extraction test. More particularly, the gasket is immersed in methylene chloride at room temperature for 24 hours. Usually about 15 to 20 ml of the methylene chloride is sufficient. If a color develops in the liquid methylene chloride, the degredation catalyst is present and, conversely, if the methylene chloride does not develop color, the catalyst is absent. In view of this finding, appropriate steps are taken that any portion of gasket 9 which is in communication with the interior of the container containing the irritant composition is substantially free of the material which is extractable by the halocarbon to form color. This can be accomplished without changing the conventional construction of the aerosol container by employing a rubber material which does not contain the extractable material. For example, the pharmaceutical grade of Buna N, known in the trade as Buna P, has been found not to contain a colored extractable material. Accordingly, using a Buna P gasket 9 will increase storage stability. Similarly, increasing the inner diameter of gasket 9 as shown in FIG. 2 will also increase stability. Alternatively, the construction of the valve assembly can be altered in order to isolate gasket 9 from the interior of the container. One suitable arrangement is shown in FIG. 3.

Figure 1:
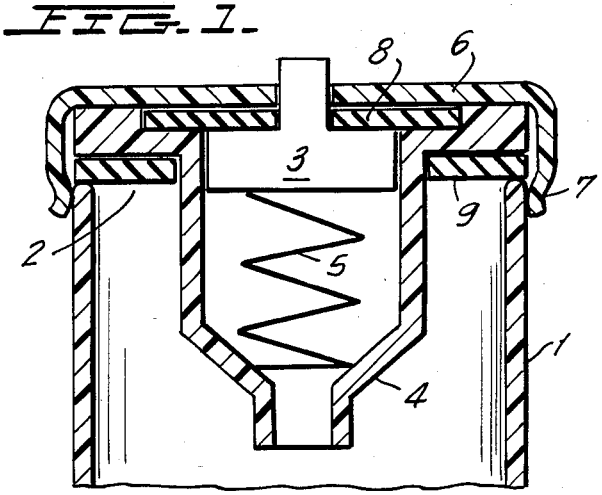
Figure 3:
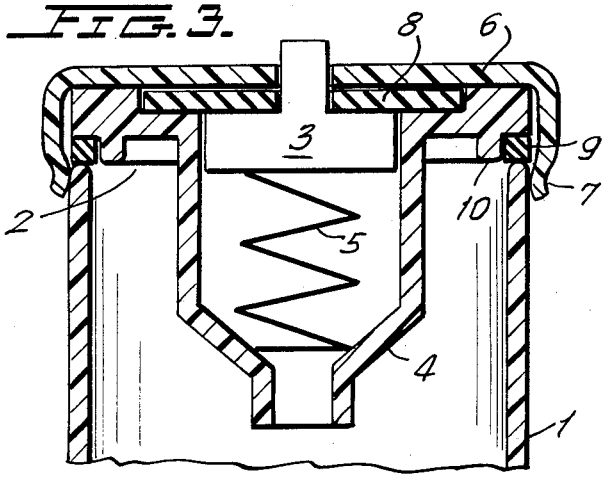
FIG. 3 is a cross section similar to FIG. 1 showing a third embodiment of the invention.

The general configuration of the embodiment shown in FIG. 3 is the same as FIG. 1 and the same reference numerals have been used for convenience. It will be noted that retainer 4 has been provided with an annular skirt portion 10 at a point displaced from the peripheral edge of retainer 4 so that it will telescope into and engage an annular portion of wall 1. The inner diameter of gasket 9 shown in FIG. 3 has been significantly increased so that gasket 9 is retained in the annular area defined between container wall 1 and skirt 10, and the peripheral portion of retainer 4 and cover 6. In this way, gasket 9 is substantially isolated from the interior of the container which contains the CS irritant and therefore need not be free of the catalyst material. Any slight leakage of the CS irritant between skirt 10 and wall 1 can be tolerated.

In order to illustrate the foregoing, a series of stability tests were conducted in a cylindrical container constructed as shown in FIG. 1. The irritant composition contained about 1% CS, about 9% acetone, about 90% trichlorotrifluoroethane, about 0.1% water and 45 psig $CO_2$. Gaskets made of Buna N, Buna P, EPDM, Hypalone (a brand of chlorosulfonated polyethylene) and neoprene were subjected to the extraction test and then to storage stability tests at 70° F., 110° F., 135° F. and 160° F. and the number of days of acceptable storage stability were noted. The tests were terminated at 300 days maximum. The results were as follows:

Neoprene—this rubber turned the methylene chloride brown. Stability tests were terminated at 60 days when it was observed that the stability at 135° F. was less than 30 days and was less than 60 days at 110° F.

EPDM—This rubber turned the methylene chloride slightly pinkish. The stability test results were:

| | |
|---|---|
| 160° | less than 60 days |
| 135° | 60–90 days |
| 110° | 120–200 days |
| 70° | 300 days + |

Buna N—This rubber turned the methylene chloride a yellow brown and the stability tests showed:

| | |
|---|---|
| 160° | less than 60 days |
| 135° | less than 60 days |
| 110° | less than 90 days |
| 70° | 9 months (estimate) |

Hypalon—This rubber did not turn the methylene chloride color. The stability results were

| | |
|---|---|
| 160° | less than 60 days |
| 135° | more than 60 but less than 90 |
| 110° | 90–120 days |
| 70° | 300+ days |

Buna P—This rubber did not turn the methylene chloride color. The stability results were:

| | |
|---|---|
| 160° | 60–90 days |
| 135° | 300+ days |
| 110° | 300+ days |
| 70° | 300+ days |

Since as a general rule the stability at 70° is about three times the stability at 135°, the superior storage stability of the Buna P is evident.

In addition to the foregoing, a butyl rubber gasket was found to turn the methylene chloride yellow brown and had a storage stability of less than 120 days at 110°. Since the general rule is that stability at 110° is about double the 70° stability, the butyl rubber gasket is clearly inferior.

To show the effect of the water content, the foregoing tests were repeated with Buna N and Buna P gaskets for a period of 100 days maximum for three irritant compositions of different water content. The results are shown in Table II below:

TABLE II

| Gasket | 0.08% Water | 0.18% Water | 0.28% Water |
|---|---|---|---|
| Buna N | 60–70 days | 30–45 days | 14–20 days |
| Buna P | 100 days | 60–70 days | 40–50 days |

In a preferred embodiment of the present invention, the aerosol spray unit has a built-in safety device. For maximum utility, the irritant spray unit should be usable without actually being looked at, i.e. by the use of feel alone, and it is therefore necessary that the safety device can be set to the "safe" position or "fire" position by feel alone, for example, in the dark. The safety is also important to prevent accidental discharge but will interfere with efficient use of the device if two hands are necessary to activate the unit. A suitable safety device is shown in FIGS. 4 through 10.

FIGS. 4, 5, 5a, 5b, 6 and 7 show a housing 110 and an actuator 111 constructed in accordance with this invention. Housing 110 is a generally hollow member having a first end 112 and a second end 113 with a tubular opening 114 extending along the axis between the first end 112 and second end 113. Housing 110 also contains a first slot 115 and a second slot 116 which are aligned and have an axis which is substantially perpendicular to the axis between first end 112 and second end 113 of housing 110. Second end 113 of housing 110 is adapted to be connected to the aerosol container such as by fitting over and in frictional engagement with cover 6 of the valve assembly shown in FIG. 1 (see FIG. 10).

Housing 110 slidably receives actuator 111 which can move along the axis between first end 112 and second 113. The shape of actuator 111 generally conforms to the shape of housing 110 so that actuator 111 is always in alignment. The actuator includes a valve actuating body 117 projecting from one end thereof which is designed to actuate or operate, for example, valve 3 shown in FIGS. 1 through 3. When actuator 111 is depressed, the valve actuating body 117 comes into engagement with the valve causing the latter to operate and release the irritant spray from the container. The actuator 111 and valve actuating body 117 preferably have a conduit 118 extending therethrough leading from the valve to a nozzle 119 through which the irritant spray exits the aerosol container unit. The nozzle 119 preferably rides within slot 115, shown in FIG. 4. Slot 115 has the shape of an inverted "T" configuration so that nozzle 119 rides within the upwardly extending leg of the "T". This arrangement further acts to maintain actuator 111 in proper alignment within housing 110.

Actuator 111 is provided with interference means at the same end thereof as the valve actuating body 117. FIG. 7 shows the interference means as webs or projections 120 which extend outwardly of valve actuating body 117.

Housing 110 is also provided with a generally flat "U" shaped slide member 121 which is best illustrated in FIGS. 7, 8 and 9. The legs 122 and 123 of slide 121 are flexible in the plane of slide 121 and at least a portion of the area between legs 122 and 123 define an aperture 124 to permit the valve actuating body 117 of actuator 111 to extend through legs 122 and 123. Slide 121 fits through and is carried between slots 115 and 116 in housing 110. The peripheral portion 125 of the base of the "U" shaped slide and the peripheral ends 126, 127 of legs 122 and 123 are preferably contoured to conform with the contours of housing 110 in the vicinity of aligned slots 115 and 116. Slide 121 is slideably mounted in slots 115 and 116 and movable in a direction substantially perpendicular to the axis between first end 112 and second end 113 of housing 110.

Slide 121 has a pair of interference projections 128 extending from its surface. Interference projections 128 are movable with slide 121 between a blocking position and releasing position relative to interference means 120 carried by actuator 111. When interference projections 128 and interference means 120 are aligned, they will prevent actuator 111 from being sufficiently depressed to actuate the valve 3 and will thereby prevent discharge of the irritant composition within the container. When interference projection 128 and interference means 120 are not aligned, actuator 111 can be depressed so as to activate the valve and permit release of the irritant spray.

The outer edges of legs 122 and 123 of slide 121 have a pair of indentations or notches 129, 130 which are adapted to be received in the edges of slot 115. Indent 129 is disposed so that it is received in the edges of slot 115 when interference projections 128 and interference means 120 are aligned, i.e., when activation of the container valve is prevented and the container is in the "safe" mode. Indent 130 is disposed such that it is received in the edges of slot 115 when interference projection 128 and interference means 120 are out of alignment so that the actuator can be moved to activate the container valve and the irritant container unit is in the "fire" mode. Since legs 122 and 123 are flexible, slide 121 can be relatively easily moved between the "safe" position and the "fire" position by applying pressure to either the peripheral end of connecting "U" portion 125 or the peripheral ends 126 and 127 of legs 122 and 123 which will cause the slide to travel from one indentation to the other. Note that the exposed "U" shaped connecting portion 125 of slide 121 and the activating surface 131 of actuator 111 are disposed in sufficiently close relationship that they can be contacted at the same time by the same digit, usually the individual's thumb. This permits the individual to use his or her thumb to rapidly and successively exert pressure against portion 125 of slide 121 thereby causing slide 121 to move from the "safe" to "fire" position and to exert downward pressure on actuator 111 thereby activating the container valve and causing expulsion of the irritant spray.

FIG. 10 shows another embodiment of an actuator of the present invention. In this embodiment, the actuator housing 200 has a generally circular configuration as opposed to the square configuration of the actuator 111 shown in FIGS. 4 through 7. Housing 200 is situated on a generally cylindrical container 201 and in this embodiment, the actuating surface 202 has a portion 203 which is sloped toward slide 204 to facilitate depression of the actuator.

Although the present invention has been described with respect to the preferred embodiments thereof, various changes and modifications can be made in the apparatus of the present invention without departing from the spirit and scope thereof. The various embodiments which have been disclosed herein were for the purpose of further illustrating the invention but were not intended to limit it.

We claim:

1. An aerosol irritant spray container comprising a container having a peripheral opening therein, a valve assembly within said peripheral opening, and a gasket between said valve assembly and the end of said peripheral opening, said gasket presenting no area to the interior of said container which is not characterized by being substantially free of material extractable by methylene chloride to form color in said methylene chloride extractant.

2. The aerosol irritant container of claim 1 wherein said valve assembly comprises a valve and a valve seat and said gasket is disposed between said valve seat and said container.

3. The aerosol irritant container of claim 2 wherein said gasket is formed of Buna rubber substantially free of material extractable by methylene chloride to form color in said methylene chloride extractant.

4. The aerosol irritant container of claim 2 wherein said valve seat has a skirt extending therefrom and into the interior of said container, said skirt being disposed between the seal between said peripheral end of said container and said seat thereby to shield the exposed surface of said gasket from the contents of said interior of said container.

5. The aerosol irritant container of claim 1 containing a substantially anhydrous aerosol irritant composition comprising about 0.5–1.5% CS, about 83.5–99.5% solvent, up to about 7% low boiling dispersant and about 30–60 psig of a propellant selected from the group consisting of carbon dioxide and nitrous oxide.

6. The aerosol irritant container of claim 5 wherein said aerosol irritant composition contains from about 8–15% acetone and 75.5–91.5% trichlorotrifluoroethane as said solvent.

7. An aerosol irritant spray container comprising a container having a peripheral opening therein, a valve assembly within said peripheral opening, and a gasket between said valve assembly and the end of said peripheral opening presenting a finite area to the interior of said container, said area being formed of Buna rubber, said rubber being substantially free of material extractable by methylene chloride to form color in said methylene chloride extractant.

* * * * *